United States Patent [19]

Dennis

[11] Patent Number: 4,662,896

[45] Date of Patent: May 5, 1987

[54] METHOD OF MAKING AN ABRASIVE CUTTING ELEMENT

[75] Inventor: Mahlon D. Dennis, Kingwood, Tex.

[73] Assignee: Strata Bit Corporation, Houston, Tex.

[21] Appl. No.: 830,722

[22] Filed: Feb. 19, 1986

[51] Int. Cl.[4] ..... B24D 3/00

[52] U.S. Cl. ..... 51/293; 51/309

[58] Field of Search ..... 51/293, 309

[56] References Cited

U.S. PATENT DOCUMENTS

| | | | |
|---|---|---|---|
| 3,743,489 | 7/1973 | Wentry, Jr. et al. | 51/309 |
| 4,073,354 | 2/1978 | Rowley et al. | 175/329 |
| 4,098,363 | 7/1978 | Bohde et al. | 175/329 |
| 4,156,329 | 5/1979 | Daniels et al. | 51/309 |
| 4,457,765 | 7/1984 | Wilson | 51/293 |
| 4,504,284 | 3/1985 | Ohno | 51/293 |
| 4,505,721 | 3/1985 | Almond et al. | 51/293 |
| 4,604,106 | 8/1986 | Hall et al. | 51/293 |

*Primary Examiner*—Paul Lieberman
*Assistant Examiner*—Willie J. Thompson
*Attorney, Agent, or Firm*—Burns, Doane, Swecker & Mathis

[57] ABSTRACT

An abrasive compact is made by a method comprising the steps of providing a circular cylindrical substrate having an upper with a non-circular recess therein defined by non-intersecting side walls. The recess is filled with diamond grains and is positioned in a press. The substrate and diamond grains are subjected to high temperature and pressure conditions in the press to sinter the diamond grains and bond the sintered diamond grains to the substrate in the form of a non-circular diamond layer. The portions of the substrate not covered by the diamond layer are removed.

6 Claims, 7 Drawing Figures

FIG. 7
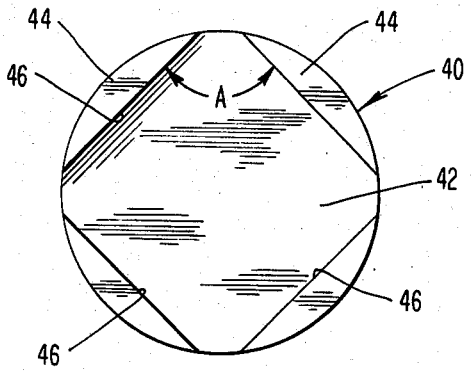
FIG. 4
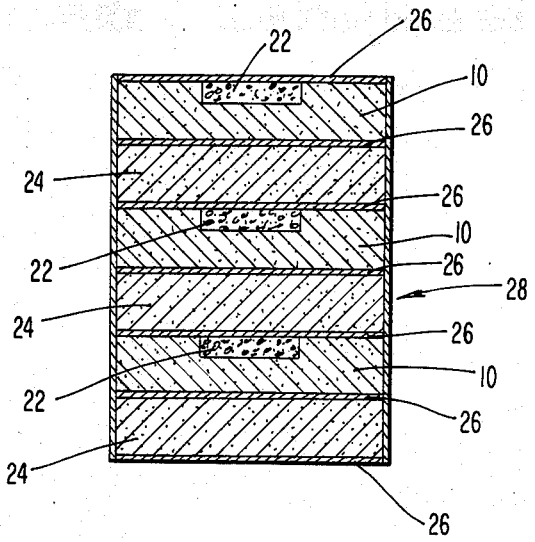
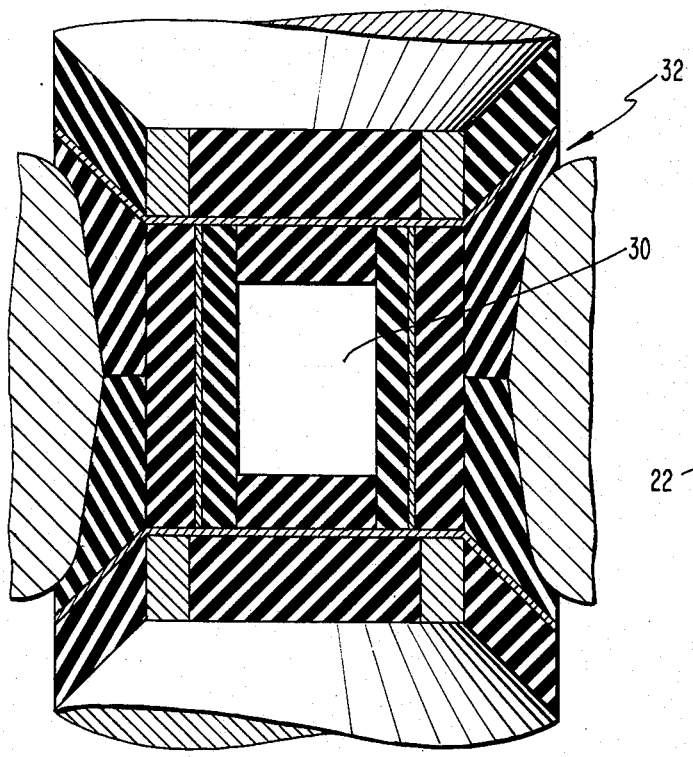
FIG. 5
PRIOR ART
FIG. 6
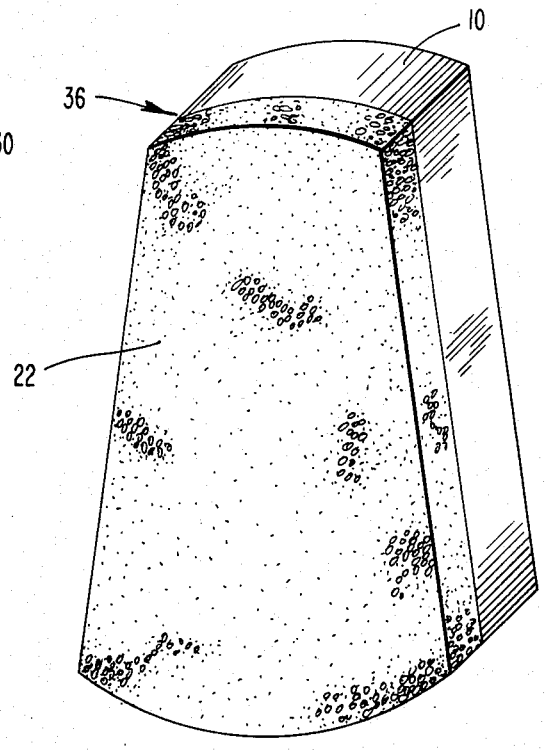

METHOD OF MAKING AN ABRASIVE CUTTING ELEMENT

BACKGROUND AND OBJECTS OF THE INVENTION

The present invention relates to cutting elements of the type which are mounted on rotary drill bits for cutting through formations, including rock formations, cement plugs, etc.

Rotary drilling operations in such formations are typically carried out using a rotary drill bit which is simultaneously rotated and advanced into the formation. Cutting is performed by cutting elements mounted on the drill bit, and the cuttings are flushed to the top of the borehole by the circulation of drilling fluid.

A conventional cutting element may comprise a cutting blank or abrasive compact mounted on a cemented carbide stud. The blank may include a thin diamond disk which is suitably secured to an inclined face of the stud, and the stud 18 is then secured, e.g., by press-fit, in a recess of the drill bit. Cutting elements of this type are disclosed, for example, in Rowley et al U.S. Pat. No. 4,073,354; Rohde et al U.S. Pat. No. 4,098,363; and Daniels et al U.S. Pat. No. 4,156,329.

The thin diamond disk of the cutting element is comprised of a cluster of abrasive diamond grains bonded together. Bonding of the abrasive cluster to the substrate can be effected either during or after the formation of the abrasive cluster. Attention is directed to U.S. Pat. Nos. 3,743,489, 3,745,623, and 3,767,761, for examples of various compacts and methods of fabricating same. One approach to such fabrication involves the placement of synthetic or natural diamond grains onto a circular flat surface of a cylindrical carbide substrate. The substrate is then placed in a press where the diamond grains and substrate are pressed together while being heated to a temperature below the degradation temperature of the diamond grains. If desired, a separate bonding medium can be mixed with the diamond grains. Pressure against the diamond grains is effected by a circular pressing surface of the same diameter as the substrate in order to achieve a uniform force distribution. There is thus formed an abrasive compact comprising a circular cylindrical substrate having a thin circular layer of bonded diamond grains thereon.

In certain types of cutting operations, it may be preferable to employ a cutting element which possesses a diamond layer of chisel-shape rather than circular shape. In those instances, it has been the practice to form an abrasive contact having a circular diamond layer, and thereafter grind away segments of the disc to a chisel shape. It will be appreciated that such an operation, especially the grinding of diamond, is difficult and costly. To attempt to otherwise fabricate the compact, for example, by configuring the substrate initially of chisel shape and placing that substrate, together with diamond grains, in a chisel-shaped press would not be practical because the presence of flats and corners along the side edges of the diamond layer would result in uneven radial pressures being imposed which would adversely affect the integrity of the bonding process.

It is, therefore, an object of the present invention to minimize or obviate problems of the type discussed above.

Another object is to provide a simpler and less costly method for fabricating chisel-shaped abrasive compacts.

A further object is to provide such a method which eliminates the need for appreciable grinding of diamond.

SUMMARY OF THE INVENTION

These objects are achieved by the present invention which relates to a method of making a non-circular abrasive compact. The method comprises the steps of providing a circular cylindrical substrate having an upper surface with a non-circular recess therein defined by spaced side walls. The recess is filled with diamond grains and is positioned in a press. The substrate and diamond grains are subjected to high temperature and pressure conditions in the press to sinter the diamond grains and bond the sintered diamond grains to the substrate in the form of a non-circular diamond layer. Portions of the substrate not covered by the diamond layer are removed.

Preferably, the side walls are non-parallel and non-intersecting and are in the form of straight chords extending across the upper surface.

The substrate is preferably formed of cemented carbide, such as tungsten carbide.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 4 is a longitudinal sectional view taken through a stack of substrates prior to insertion thereof into a press;

FIG. 5 is longitudinal sectional view taken through a conventional press;

FIG. 6 is a perspective view of a cutting element following removal of the portions not covered by the diamond layer; and FIG. 7 is a top plan view of a modified substrate for forming a cutting element of a different shape.

DETAILED DESCRIPTION OF A PREFERRED EMBODIMENT OF THE INVENTION

Figure 1:
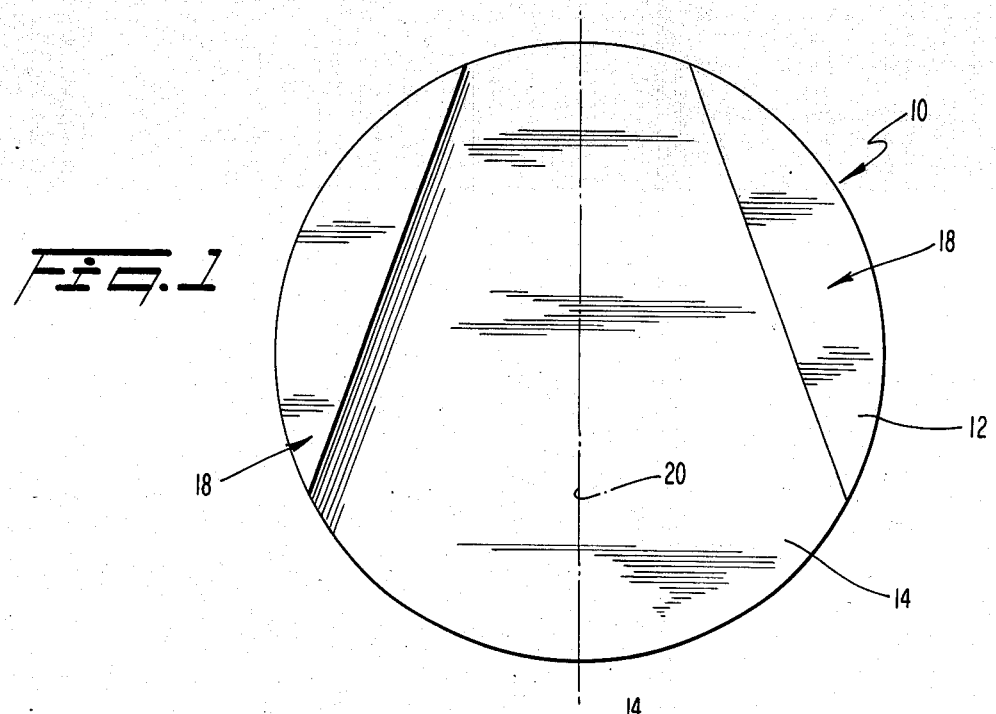
FIG. 1 is a stop plan view of substrate having a recess therein according to the present invention.
Figure 2:
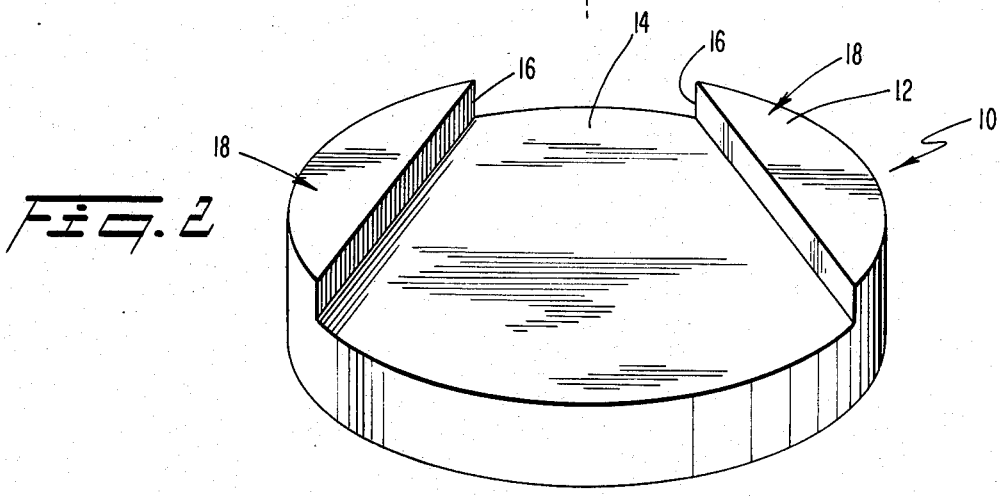
FIG. 2 is a front perspective view of the substrate depicted in FIG. 1.

In accordance with the present invention, a cylindrical substrate 10 (FIGS. 1 and 2) is provided which is preferably formed of a cemented carbide such as cemented tungsten carbide. In an upper surface 12 of the substrate is formed a chisel-shaped recess 14 bordered by a pair of side walls 16 arranged as chords of a circle defined by the upper surface as viewed in FIG. 1. The side walls preferably diverge in one direction and converge in the opposite direction. For example, the side walls 16 may form an included angle of 102 degrees. There are thus formed a pair of upwardly projecting webs 18 which border the recess 14. The recess and webs are symmetrical about a longitudinal reference plane 20 bisecting the recess.

To form a cutting element, the recess 14 is filled with a charge 22 of natural or synthetic diamond grains. A plurality of such diamond-filled substrates are vertically stacked, with spacer disks 24 interposed between the substrates. The disks 24 can be formed of a suitable material such as salt, talc, etc. Shielding plates 26 are disposed at the top and bottom of the stack and between the substrates 10 and disks 24. The thus-formed stack 28 is placed in the space 30 of a conventional high temperature, high pressure apparatus 32, the construction and operation of which being conventional and described in detail in U.S. Pat. Nos. 2,941,248, 3,609,818 and 3,745,623, the disclosures of which being incorporated herein by reference.

The stack is subjected to high temperature, high pressure conditions within the apparatus 32. For example, pressures in the range of from 1300 1600 degree C. can be applied for intervals in excess of three minutes, while a pressure on the order of 55 kilobars is applied. Further details of the operating parameters can be found in the above-mentioned patents incorporated by reference.

Figure 3:
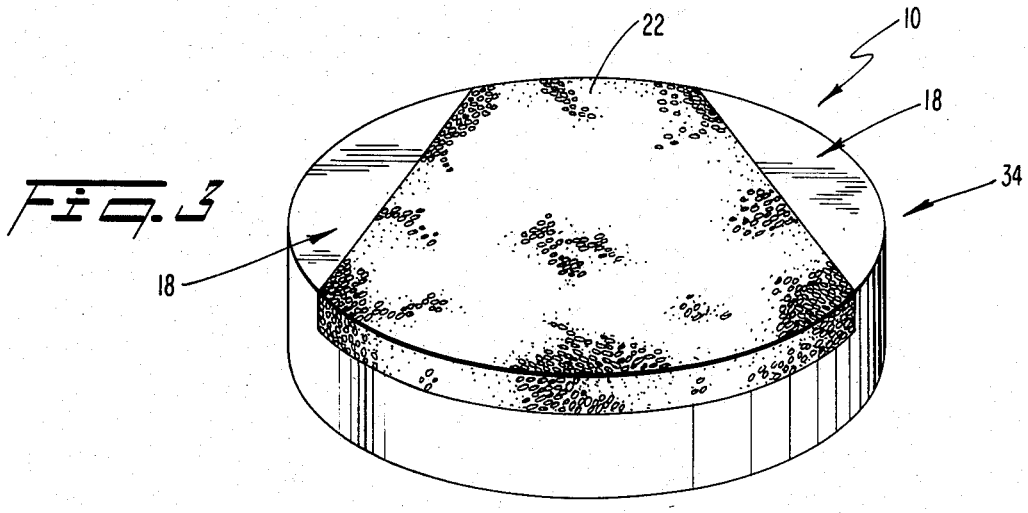
FIG. 3 is a front perspective view of a substrate after diamond grains have been sintered within the recess of the substrate.

Due to the shape of the substrate wherein the webs and diamond grains together form a circular surface against which the pressure is applied, the pressure will be uniformly distributed. Thus, there will not occur uneven pressures or pressure concentrations to adversely affect the integrity of the sintering and bonding process. As a result, the diamond grains 22 are sintered and bonded to the substrate, resulting in a cutting element 34 as depicted in FIG. 3. In order to create the desired chisel shape, the webs 18 disposed on opposite sides of the diamond layer are removed, e.g., by machining. The resultant chisel-shaped cutting element 36 is depicted in FIG. 6.

Cutting elements of other non-circular shapes can be formed in accordance with the present invention, for example, a generally square rectangular shape can be formed by a substrate 40 depicted in FIG. 7. That substrate includes a generally square recess 42 defined by two pairs of non-parallel, non-intersecting chords 44, 46 each cord situated in a respective quadrant of the substrate. Each pair of chords may form an included angle A of about 102 degrees. In effect, the cutting element which is formed constitutes a double-sided chisel; when one edge of the element becomes worn, it can be reversed and the other edge is used.

It will be appreciated that there is no need to remove any appreciable amounts of diamond material in contrast to the prior art practice described earlier herein. Thus, the fabrication of the cutting element is simpler and less expensive than has been previously possible.

Although the present invention has been described in connection with a preferred embodiment thereof, it will be appreciated by those skilled in the art that additions, modifications, substitutions and deletions not specifically described, may be made, without departing from the spirit and scope of the invention as defined in the appended claims.

What I claim is:

1. A method of making an abrasive compact comprising the steps of:

providing a circular cylindrical substrate having an upper surface with non-circular recess therein defined by spaced side walls, filling said recess with diamond grains, positioning said substrate and diamond grains in a press;

subjecting said substrate and diamond grains to high temperature and pressure conditions in said press to sinter said diamond grains and bond the sintered diamond grains to said substrate in the form of a non-circular diamond layer, and removing portions of said substrate not covered by said diamond layer.

2. A method according to claim l, wherein said providing step comprises providing a circular cylindrical substrate having an upper surface with a non-circular recess therein defined by non-parallel, non-intersecting side walls in the form of straight chords extending across said upper surface.

3. A method according to claim 1, wherein said substrate is formed of cemented carbide.

4. A method according to claim 3, wherein said cemented carbide is tungsten carbide.

5. A method according to claim 1, wherein said removing step comprises grinding.

6. A method according to claim 1, wherein said providing step comprises providing a circular cylindrical substrate having an upper surface with a non-circular recess therein defined by first and second pairs of chords, each pair of chords being non-parallel and non-intersecting and lying within respective quadrants of said substrate.

* * * * *